US009273656B2

(12) United States Patent
Schule et al.

(10) Patent No.: US 9,273,656 B2
(45) Date of Patent: Mar. 1, 2016

(54) METHOD AND CONTROL UNIT FOR CONTROLLING AN INTERNAL COMBUSTION ENGINE

(75) Inventors: Harry Schule, Neunburg V. Wald (DE); Markus Stutika, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 414 days.

(21) Appl. No.: 13/810,274

(22) PCT Filed: Jul. 4, 2011

(86) PCT No.: PCT/EP2011/061230
§ 371 (c)(1),
(2), (4) Date: Mar. 29, 2013

(87) PCT Pub. No.: WO2012/007307
PCT Pub. Date: Jan. 19, 2012

(65) Prior Publication Data

US 2013/0180506 A1 Jul. 18, 2013

(30) Foreign Application Priority Data

Jul. 15, 2010 (DE) ..... 10 2010 027 215

(51) Int. Cl.
*F02D 41/30* (2006.01)
*F02M 69/04* (2006.01)
(Continued)

(52) U.S. Cl.
CPC ..... *F02M 69/04* (2013.01); *F02D 35/023* (2013.01); *F02D 41/009* (2013.01); *F02D 41/062* (2013.01); *F02D 41/30* (2013.01); *F02D 2041/0092* (2013.01)

(58) Field of Classification Search
CPC . F02D 41/30; F02D 41/3011; F02D 41/3076; F02D 41/401; F02D 35/023; F02M 69/04
See application file for complete search history.

(56) References Cited

U.S. PATENT DOCUMENTS 4,995,351 A 2/1991 Ohkubo et al. ..... 123/90.11
5,179,857 A 1/1993 Sonderegger et al. ..... 73/114.07
(Continued)

FOREIGN PATENT DOCUMENTS

DE 4036847 A1 5/1991 ..... F02D 13/02
DE 19741820 A1 3/1999 ..... F01L 1/34
(Continued)

OTHER PUBLICATIONS

German Office Action, Application No. 10 2010 027 215.9, 3 pages, Apr. 7, 2011.
(Continued)

*Primary Examiner* — Lindsay Low
*Assistant Examiner* — Jacob Amick
(74) *Attorney, Agent, or Firm* — Slayden Grubert Beard PLLC

(57) ABSTRACT

A method and a control unit are disclosed for controlling a single-cylinder or multiple-cylinder internal combustion engine having at least one fuel injector per cylinder, at least one camshaft for actuating inlet valves and/or outlet valves, and having a control unit which controls the fuel injectors in such a way that they inject in each case one fuel pre-injection per cylinder during a starting phase of the internal combustion engine. In order to make an improved pre-injection strategy possible during the starting phase, according to the invention at least one cylinder pressure signal which is supplied by a cylinder pressure sensor for measuring the pressure in a cylinder is evaluated with regard to interference signals, and the evaluation result is taken into consideration at least during the starting phase in a determination of the camshaft angle.

20 Claims, 2 Drawing Sheets

(51) Int. Cl.

| | |
|---|---|
| ***F02D 35/02*** | (2006.01) |
| ***F02D 41/00*** | (2006.01) |
| ***F02D 41/06*** | (2006.01) |

(56) References Cited

U.S. PATENT DOCUMENTS

| | | | | |
|---|---|---|---|---|
| 5,485,822 | A | 1/1996 | Hirose et al. | 123/501 |
| 5,586,524 | A | 12/1996 | Nonaka et al. | 123/73 A |
| 6,109,225 | A | 8/2000 | Ogita et al. | 123/90.15 |
| 6,276,319 | B2 | 8/2001 | Walter et al. | 123/90.15 |
| 6,564,785 | B2 | 5/2003 | Iwasaki | 123/568.21 |
| 6,581,557 | B1 | 6/2003 | Gaessler et al. | 123/90.15 |
| 6,650,994 | B2 | 11/2003 | Mühlberger et al. | 701/114 |
| 6,659,054 | B2 | 12/2003 | Sugiyama et al. | 123/90.16 |
| 6,691,653 | B2 | 2/2004 | Denz | 123/90.15 |
| 6,880,531 | B2 | 4/2005 | Bayerle et al. | 123/490 |
| 7,398,749 | B2 | 7/2008 | Weiss et al. | 123/90.16 |
| 7,438,046 | B2 | 10/2008 | Okubo et al. | 123/321 |
| 7,689,344 | B2 | 3/2010 | Kang et al. | 701/103 |
| 7,930,093 | B2 | 4/2011 | Bauer et al. | 701/114 |
| 2004/0139949 | A1 | 7/2004 | Koseki et al. | 123/568.14 |
| 2006/0169243 | A1 | 8/2006 | Neunteufl et al. | 123/295 |
| 2006/0287806 | A1 | 12/2006 | Hori | 701/114 |
| 2007/0137619 | A1 | 6/2007 | Fader et al. | 123/435 |
| 2007/0239343 | A1* | 10/2007 | Okubo et al. | 701/105 |
| 2007/0246004 | A1 | 10/2007 | Matekunas et al. | 123/299 |
| 2008/0077304 | A1 | 3/2008 | Suzuki et al. | 701/102 |
| 2009/0084333 | A1 | 4/2009 | Cleary et al. | 123/90.17 |
| 2009/0198474 | A1 | 8/2009 | Fritz et al. | 702/183 |
| 2009/0228190 | A1 | 9/2009 | Loeffler et al. | 701/103 |
| 2010/0318280 | A1 | 12/2010 | Moriya et al. | 701/103 |
| 2011/0224886 | A1 | 9/2011 | Wang et al. | 701/103 |
| 2011/0301828 | A1 | 12/2011 | Moriya et al. | 701/105 |
| 2013/0180505 | A1 | 7/2013 | Schtüle et al. | 123/445 |
| 2013/0180506 | A1 | 7/2013 | Schtüle et al. | 123/472 |

FOREIGN PATENT DOCUMENTS

| | | | | |
|---|---|---|---|---|
| DE | 10056862 | C1 | 5/2002 | F02D 41/04 |
| DE | 10064650 | A1 | 7/2002 | F01L 1/00 |
| DE | 10356257 | A1 | 7/2005 | F01L 13/00 |
| DE | 10028995 | B4 | 10/2005 | F01L 1/34 |
| DE | 102004023589 | A1 | 1/2006 | F02D 13/00 |
| DE | 102005062558 | A1 | 6/2007 | F01L 9/02 |
| DE | 102006062038 | A1 | 7/2007 | F02D 13/02 |
| DE | 102006061566 | A1 | 7/2008 | F02D 41/00 |
| DE | 102008004442 | B3 | 7/2009 | F02D 41/00 |
| DE | 112008001529 | T5 | 4/2010 | F01L 1/34 |
| EP | 0459946 | A1 | 12/1991 | F02B 77/08 |
| EP | 1338778 | A1 | 8/2003 | F01L 13/00 |
| WO | 2004/048761 | A1 | 6/2004 | F01L 9/04 |
| WO | 2012/007307 | A1 | 1/2012 | F02D 41/06 |
| WO | 2012/007323 | A1 | 1/2012 | F02D 13/02 |
| WO | 2012/007336 | A1 | 1/2012 | F01L 13/00 |

OTHER PUBLICATIONS

German Office Action, Application No. 10 2010 027 213.2, 3 pages, Apr. 8, 2011.

German Office Action, Application No. 10 2010 027 214.0, 3 pages, Apr. 11, 2011.

International Search Report and Written Opinion, Application No. PCT/EP2011/061331, 16 pages, Oct. 4, 2011.

International Search Report and Written Opinion, Application No. PCT/EP2011/061230, 15 pages, Oct. 4, 2011.

International Search Report and Written Opinion, Application No. PCT/EP2011/061413, 16 pages, Oct. 14, 2011.

German Office Action, Application No. 10 2010 027 215.9, 4 pages, Jan. 24, 2013.

German Office Action, Application No. 10 2010 027 214.0, 4 pages, Jan. 24, 2013.

U.S. Final Office Action, U.S. Appl. No. 13/810,260, 19 pages, Aug. 27, 2015.

U.S. Final Office Action, U.S. Appl. No. 13/810,235, 23 pages, Oct. 27, 2015.

* cited by examiner

METHOD AND CONTROL UNIT FOR CONTROLLING AN INTERNAL COMBUSTION ENGINE

CROSS-REFERENCE TO RELATED APPLICATIONS

This application is a U.S. National Stage Application of International Application No. PCT/EP2011/061230 filed Jul. 4, 2011, which designates the United States of America, and claims priority to DE Application No. 10 2010 027 215.9 filed Jul. 15, 2010, the contents of which are hereby incorporated by reference in their entirety.

TECHNICAL FIELD

The present disclosure relates to a method and a control unit for controlling an internal combustion engine.

The disclosure relates, for example, to the control of a spark-ignition or diesel engine, which is used as a source of motive power in a motor vehicle with an "automatic start/stop function" or in a hybrid vehicle. Common to these applications is the fact that the internal combustion engine is switched on and off relatively often as part of energy-efficient drive management of the vehicle concerned.

BACKGROUND

A method and a control unit for controlling an internal combustion engine is known from DE 100 56 862 C1, for example.

This prior art is concerned with a special "strategy" for injecting a preliminary fuel injection into each cylinder when starting the engine (internal combustion engine), even before a complete knowledge ("synchronization") of the crankshaft angle and of the camshaft angle is available.

Preliminary injections serve to provide each cylinder with an ignitable mixture for the first combustion during the starting phase. In this case, a specific preliminary injection strategy is required in order to minimize emissions of unburned fuel and hence increased pollutant emissions during engine starting.

Admittedly, it would be possible to avoid excessive pollutant emissions by outputting the preliminary injections only when the precise angular positions of the crankshaft and the camshaft are known. Owing to the customary configuration of crankshaft and camshaft sensors, however, this requires a certain time or crankshaft and camshaft rotation, and therefore engine starting would be considerably delayed.

The preliminary injection strategy provided by DE 100 56 862 C1 is based on the knowledge that an internal combustion engine almost always comes to a halt at one of a number of particular discrete angular positions of the crankshaft and the camshaft in the decoupled state after being switched off, there being several such positions owing to the design and the number of discrete angular positions over two crankshaft revolutions)(720°) corresponding to the number of cylinders. In the case of 4 cylinders, for example, there are therefore 4 preferential stoppage angles of the crankshaft. Even when this knowledge is allowed for when evaluating the crankshaft signal and camshaft signal during the starting phase, there remains a degree of uncertainty with this known strategy. Admittedly, in the illustrative embodiment described, it is, for example, ensured that preliminary injections are output only for cylinders on which the inlet valve is closed or predominantly closed at this point in time, and therefore combustion of these preliminary injections is reliably ensured. However, it is disadvantageous that an earlier point in time that is in fact already suitable for a preliminary injection may be "missed".

SUMMARY

One embodiment provides a method for controlling a single- or multi-cylinder internal combustion engine having at least one fuel injector per cylinder for injecting fuel, at least one camshaft for actuating inlet valves and/or outlet valves, which rotates at half the speed of a crankshaft, a crankshaft sensor, which supplies a crankshaft signal having a synchronization pulse for each crankshaft revolution, said signal representing the crankshaft angle, and a control unit, which controls the fuel injectors in such a way that they inject a preliminary fuel injection into each cylinder during a starting phase, and then inject fuel quantities determined by the control unit in the normal injection mode in a normal operating phase, wherein at least one cylinder pressure signal, which is supplied by a cylinder pressure sensor for measuring the pressure in an associated cylinder, is evaluated with regard to interference signals, and in that the evaluation result is allowed for in a determination of the camshaft angle, at least during the starting phase.

In a further embodiment, the internal combustion engine has a plurality of cylinders, and the cylinder pressure signals of cylinder pressure sensors respectively associated with all the cylinders are evaluated.

In a further embodiment, preferential stoppage angles of the crankshaft are furthermore allowed for in determining the camshaft angle during the starting phase.

In a further embodiment, the camshaft angle supplied by the camshaft sensor is furthermore allowed for in determining the camshaft angle.

In a further embodiment, the evaluation result is used during the starting phase and/or in the normal operating phase to check the plausibility of the crankshaft signal supplied by the crankshaft sensor and/or of the camshaft signal supplied by a camshaft sensor and dependent on the camshaft angle.

In a further embodiment, a camshaft angle phase adjustment is provided in the normal operating phase, and the evaluation result is allowed for as an input variable in the control of the camshaft phase adjustment.

Another embodiment provides a control unit for controlling a single- or multi-cylinder internal combustion engine having at least one fuel injector per cylinder for injecting fuel, at least one camshaft for actuating inlet valves and/or outlet valves, which rotates at half the speed of a crankshaft, a crankshaft sensor, which supplies a crankshaft signal having a synchronization pulse for each crankshaft revolution, said signal representing the crankshaft angle, and a control unit, which controls the fuel injectors in such a way that they inject a preliminary fuel injection into each cylinder during a starting phase, and then inject fuel quantities determined by the control unit in the normal injection mode in a normal operating phase, wherein the control unit is designed to evaluate at least one cylinder pressure signal, which is supplied by a cylinder pressure sensor for measuring the pressure in an associated cylinder, with regard to interference signals, and to allow for the evaluation result in a determination of the camshaft angle, at least during the starting phase.

BRIEF DESCRIPTION OF THE DRAWINGS

Exemplary embodiments will be explained in more detail below based on the schematic drawings, wherein.

DETAILED DESCRIPTION

Figure 1:
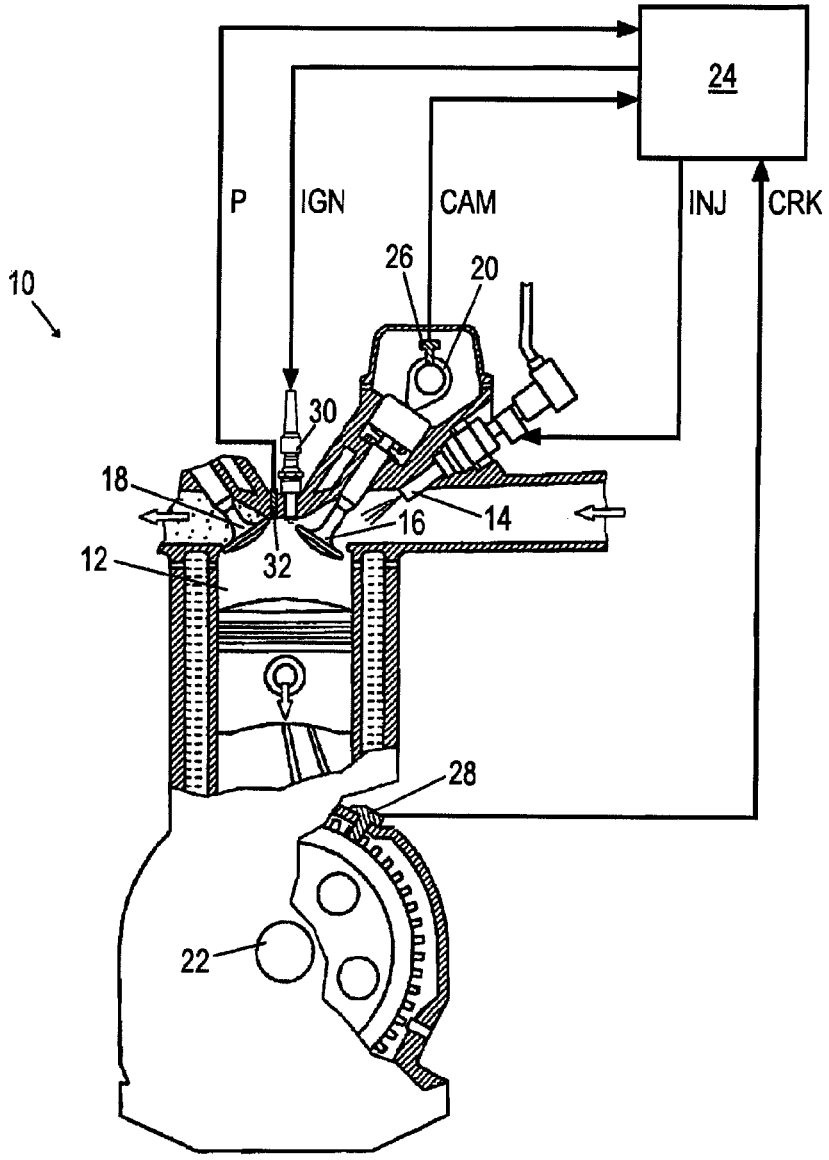
FIG. 1 shows a schematic sectioned view of an internal combustion engine in the form of a 4-stroke spark-ignition engine.

Embodiments of the present disclosure may make available more information on the state of the engine, e.g., for determining the camshaft angle, during the starting phase in order to enable an improved preliminary injection strategy. This information may supplement information from sensor systems, e.g., crankshaft and camshaft sensors.

In some embodiments, at least one cylinder pressure signal, which is supplied by a cylinder pressure sensor for measuring the pressure in an associated cylinder, is evaluated with regard to interference signals, and that the evaluation result is allowed for in a determination of the camshaft angle, at least during the starting phase.

Cylinder pressure sensors are known per se in the engine engineering sector and are used to measure cylinder pressure. In the prior art, the cylinder pressure signal is used only for evaluating combustion. By this means, it is possible, for example, to determine and/or correct faults in the metering of the fuel, of the air mass or of a recirculated fraction of the combustion exhaust gas. For this purpose in the prior art, either only a single cylinder pressure sensor on one of the cylinders is used as a representative of the sum total of all the cylinders or, as an alternative, a dedicated cylinder pressure sensor is provided for each cylinder.

Cylinder pressure sensors of this kind generally have such a high sensitivity or such a high resolution in measuring the cylinder pressure that they are also susceptible to interfering noise propagating (as structure-borne noise) through a cylinder block, e.g. a metal cylinder block. The basic idea consists in using the interference signals caused by such interfering noise in one or more cylinder pressure signals detected by one or more cylinder pressure sensors as information relating to the state of the engine, in particular the camshaft angle, during the starting phase. When one or more camshafts are rotating in order thereby to drive the valves (opening and closing of inlet and outlet valves), noise arises, leading to characteristic interference signals in the cylinder pressure signal or signals. The disclosed evaluation of the (at least one) cylinder pressure signal with regard to such interference signals can thus be used in an advantageous manner to draw conclusions about the camshaft angle. This is accomplished, for example, by employing suitably predetermined evaluation criteria, by means of which identification of processes in the valve gear can be performed in the engine control unit.

One possible evaluation criterion can consist, for example, in detecting sudden changes, that is to say, for instance, discontinuities or "signal peaks" in the measured pressure profile and using the characteristic thereof (e.g. amplitudes, frequency components, duration etc.) and/or additional information on the position of the engine (e.g. preferential stoppage angle, crankshaft signal, camshaft signal etc.) to assign them to a very specific process in the valve gear. Such a procedure is significantly simpler, quicker and often more accurate than, for example, evaluation on the basis of a comparison between the measured pressure profile (cylinder pressure signal) and typical pressure profiles stored in advance.

In particular, evaluation can be performed with regard to interference signals which are caused by the inlet valves and/or outlet valves when they are actuated.

An interference signal which stands out particularly clearly in practice and is therefore relatively simple to detect by evaluation occurs, for example, when a closing process of a valve (inlet or outlet valve) comes to an end. The landing of a valve body (e.g. valve disk) on a sealing surface in the region of a wall delimiting the associated cylinder, which occurs at this point in time, leads to a mechanical shock which is very clearly evident as an interference signal (e.g. "signal peak") in the actual useful signal (representative of the cylinder pressure).

In the case of multi-cylinder internal combustion engines, it may be preferred, particularly with regard to simple and reliable identification of the valve which has caused a particular interference signal, that the cylinder pressure signals of cylinder pressure sensors respectively associated with all the cylinders are evaluated. For this purpose, each cylinder must be provided with at least one cylinder pressure sensor, which can be installed in the region of a cylinder head concerned, for example.

In principle, it is possible to detect the noise of opening and closure of the inlet and of the outlet valve by means of a cylinder pressure sensor and appropriate evaluation of the cylinder pressure signal supplied thereby. To determine the camshaft angle during the starting phase, the point in time of an interference signal caused by opening or closure of an inlet valve or of an outlet valve can accordingly be allowed for, in particular. The respective strength of the interference signals caused thereby depends, for example, on the specifically selected installation position of the sensor. Through appropriate installation of the cylinder pressure sensor, e.g. closer to an inlet valve than to an outlet valve of the cylinder concerned, it is possible to bring about interference signals from the inlet valve, on the one hand, and from the outlet valve, on the other hand, which can be distinguished qualitatively and/or quantitatively from one another in the context of evaluation, thus advantageously making it possible to identify in a simple manner the valve giving rise to a particular interference signal (e.g. from the interference signal amplitude).

In one embodiment, it is envisaged that preferential stoppage angles of the crankshaft are furthermore allowed for in determining the camshaft angle during the starting phase. This allowance can be made, for example, as in DE 100 56 862 C1, which was mentioned at the outset, i.e. by using preferential stoppage angles of the crankshaft and/or of the camshaft that are known in advance or stored in the control unit when determining the crankshaft angle and the camshaft angle, in order to obtain a complete knowledge of the position of the engine (synchronization) more quickly in the starting phase.

It may thus be possible to perform a quick start while obtaining certainty more quickly on the precise position of the engine and hence with an optimum preliminary injection strategy.

If the result of evaluating the cylinder pressure signal with regard to interference signals is allowed for during the starting phase or is allowed for in addition to the camshaft signal which is normally present, this leads more rapidly to a knowledge of the position of the engine. Depending on the number of cylinders and the preferential stoppage angles of the crankshaft which are obtained for them by virtue of the design, it is often possible by means to determine a first actuation (in particular closing, for example) of a valve just a few degrees of crank angle after the actuation of a starter, and this is particularly advantageous.

In one embodiment, the camshaft signal supplied by a camshaft sensor is allowed for in determining the camshaft angle during the starting phase and/or in the subsequent normal operating phase. In this regard, however, attention should be drawn to the possibility of dispensing with the use of the camshaft sensor or with the camshaft signal supplied thereby in determining the camshaft angle, a possibility which is conceivable in principle within the scope of this disclosure. In principle, it is conceivable, in determining the camshaft angle, whether during the starting phase or in the subsequent normal operating phase, to use the evaluation result relating to the interference signals of the cylinder pressure signal for this purpose.

The information as to whether and how quickly the crankshaft is rotating is obtained from the crankshaft signal in the case of known engines. This is generally a "tooth signal": each pulse of the crankshaft signal corresponds to one tooth on a transmitter wheel provided with a multiplicity of teeth. The synchronization pulse provided for each crankshaft revolution) (360°) generally corresponds to a single or a double "tooth gap" after the corresponding number of teeth.

The camshaft signal is used for coding the camshaft angle and, in the simplest case, has two different levels, which are assigned to two successive revolutions of the crankshaft. However, the camshaft signal can also have other signal or pulse shapes. Nevertheless, it should be ensured that the camshaft signal allows each working cycle of the engine to be divided into two segments (of 360° each) corresponding to two successive crankshaft revolutions)(720°).

Such crankshaft signals and camshaft signals, which are known per se, can also be used to advantage in the context of the this disclosure.

In one embodiment, the evaluation result is used during the starting phase and/or in the normal operating phase to check the plausibility of the crankshaft signal supplied by the crankshaft sensor and/or of the camshaft signal supplied by the camshaft sensor. This makes it possible, for example, to diagnose the case of faulty (defective) production of the camshaft signal and/or the camshaft signal and, for example, to store it as a fault entry in a diagnostic memory conventional in motor vehicles. As an alternative or in addition, plausibility checking can also be used to diagnose any assembly errors, e.g. incorrectly assembled camshaft drives, such as toothed belts or chains.

As an alternative or in addition, the cited plausibility checking of the crankshaft and/or of the camshaft signal can also serve other purposes.

Thus, according to a development, it is, for example, envisaged that the result of the evaluation of the cylinder pressure signal with regard to interference signals is used, when an implausible crankshaft signal is detected, as a replacement for this crankshaft signal or to correct this crankshaft signal and/or, when an implausible camshaft signal is detected, as a replacement for this camshaft signal or to correct this camshaft signal.

In particular, the evaluation result can thus also be used to calculate engine speed and/or to implement emergency running in the case of a faulty crankshaft sensor or a fault in the area of the provision of the crankshaft signal (to the control unit). The same applies to the case of a faulty camshaft sensor or faulty provision of the camshaft signal.

Additional advantages even extend to the fact that it is possible to dispense completely with a camshaft sensor in the internal combustion engine concerned (e.g. spark-ignition engine or diesel engine). The production of synchronization between the crankshaft and the camshaft can also be accomplished by using the result of the cylinder pressure signal evaluation described.

Some embodiments allow for the evaluation result in order to detect and then also compensate for deviations in the valve gear due to component tolerances and/or aging. Component tolerances and aging can lead, in particular, to deviation from the design times and angles for valve opening processes and valve closing processes. In this case, information obtained solely from the camshaft signal would be inaccurate as regards the times and angles of the actual opening and closing processes. However, since the actual opening and/or closing processes of the valves can be detected (even in the normal operating phase) by means of evaluation of the cylinder pressure signal with regard to interference signals, the evaluation result represents an information source for engine control, even in the normal operating phase, which is extremely valuable in practice.

In the simplest case, there is a fixed angular association between the camshaft and the crankshaft provided by coupling for conjoint rotation (in which the camshaft rotates at half the speed of the crankshaft). By means of "camshaft phase adjustment", however, it is possible for the camshaft to be turned in a controlled manner during engine operation, generally in a load- and/or engine-speed-dependent manner, relative to the crankshaft (and/or relative to another camshaft). Adjustment systems used for this purpose, also referred to as phase converters, are the most widely used variable valve timing systems in production motor vehicle engines. The cam profiles themselves and hence the valve lift and valve opening duration usually remain unchanged in the case of phase converters of this kind. The purpose of phase adjustment is to vary the "valve overlap" in accordance with one or more operating parameters of the engine concerned (e.g. load, engine speed etc). Camshaft adjusters are in use both for two discrete angular positions and for continuously variable adjustment of the relative angular position of the camshaft with respect to the relevant further shaft. Particularly in the case of continuously variable camshaft phase adjustment, only the sensor signals of the camshaft sensor and of the crankshaft sensor are allowed for as an input variable in the control of the camshaft phase adjustment in the prior art.

In one embodiment, a camshaft angle phase adjustment is provided in the normal operating phase, and the evaluation result is allowed for as an input variable in the control of the camshaft phase adjustment.

The abovementioned allowance (or joint allowance along with the crankshaft signal and the camshaft signal) for the result of the evaluation of the cylinder pressure signal with regard to the interference signals may provide precise activation of the camshaft adjustment systems. The evaluation result obtained on the basis of the cylinder pressure signal can be used, in particular, in the normal operating phase for position setting or adjustment of an actuator in a system for camshaft phase adjustment. The evaluation result gives precise points in time for the relevant processes in the valve gear, and these can serve as valuable actual-value information for a control or regulating system which is in other respects constructed in a conventional manner, for example.

The control unit used to control the internal combustion engine can be provided in conventional form as an electronic, in particular program-controlled, control unit (e.g. microcontroller). However, the disclosed control unit may be refined (e.g. by means of appropriate modification of the control software) in such a way that it performs a control method of the type described above.

Each cylinder 12 is assigned at least one injection valve or fuel injector 14 for injecting fuel (in this case gasoline) into an inlet-side intake pipe of the internal combustion engine 10.

Moreover, each cylinder 12 is assigned at least one inlet valve 16 and at least one outlet valve 18 and at least one camshaft for actuating the inlet and outlet valves. In the illustrative embodiment shown, one camshaft 20 is provided for actuating the inlet valves 16 and another camshaft (not shown) is provided for actuating the outlet valves 18.

As is known per se, there is a rotational coupling implemented between the camshafts and a crankshaft 22, e.g. via a timing chain or the like, said coupling ensuring that the camshafts rotate at half the speed of the crankshaft 22 during the operation of the internal combustion engine 10 in order thereby to accomplish a working cycle or a gas exchange in accordance with the 4-stroke method.

Among the inputs to an electronic control unit 24 are a camshaft signal CAM dependent on the rotational position of the camshaft 20 and a crankshaft signal CRK dependent on the rotational position of the crankshaft 22. These signals CAM and CRK are produced by a suitable sensor system, in this case a camshaft sensor 26 and a crankshaft sensor 28.

The signals CAM and CRK are each produced as square-wave signals in a manner known per se.

Each pulse of the crankshaft signal CRK corresponds to one tooth of a transmitter wheel, wherein a double tooth gap provides a synchronization pulse after each full revolution) (360°) of the crankshaft 22. Typically, 30 or 60 teeth (minus the teeth missing at the "gap"), for example, are arranged on the circumference of the transmitter wheel.

The two different levels of the camshaft signal CAM correspond to two successive revolutions of the crankshaft 22.

With regard to these codings of the rotational positions of the crankshaft 22 and of the camshaft 20, the disclosure of publication DE 100 56 862 C1, already mentioned at the outset, is hereby incorporated fully by reference, wherein the time profiles of the sensor signals CRK and CAM which result during engine operation are shown graphically and described in greater detail.

During the operation of the internal combustion engine 10, the electronic control unit 24 controls, in particular, fuel injection (injection times) into the cylinders 12 by means of the respectively associated fuel injector 14 (activation signal INJ). Moreover, other processes of the internal combustion engine 10 are controlled by means of the control unit 24, such as, in this case, in particular, applied ignition (ignition times) by means of a spark plug 30 (high-voltage pulse IGN) associated with each cylinder 12.

During a starting phase of the internal combustion engine 10 (immediately after actuation of a starter), a "preliminary fuel injection" is injected into each cylinder 12 before, in the normal operating phase, injection is then carried out in the normal sequential injection mode by the control unit 24 using the fuel quantities determined in the engine control software running in said control unit.

In the case of known internal combustion engines of this kind, it is problematic that a certain time or rotation of the crankshaft 22 and the camshaft 20 is required immediately after actuation of the starter before it is possible to identify the precise rotational positions of the crankshaft 22 and the camshaft 20 from the sensor signals CRK and CAM (synchronization of the engine). However, knowledge of this kind, in particular of the rotational position of the camshaft 20, which is as accurate as possible, is of decisive importance for determining when and in each case for which cylinder 12 the preliminary injections should be output in order to ensure an optimum starting process, in particular a starting process with minimized pollution.

In the case of the internal combustion engine 10 shown, this problem is solved by assigning to each of the cylinders 12 a cylinder pressure sensor 32 which supplies the control unit 24 with a cylinder pressure signal P (FIG. 2) representing the current cylinder pressure. By means of the engine control software running in the control unit 24, the cylinder pressure signal P is used to evaluate combustion in the cylinders 12 and, based on this, to meter the fuel, the air mass or a fraction of the combustion exhaust gas to be recirculated. However, it is decisive for the solution of the problem explained above that an evaluation of the cylinder pressure signal P with regard to interference signals contained therein is furthermore carried out by means of the control unit 24, and that the result of this evaluation is allowed for in determining the camshaft angle, at least during the starting phase of the internal combustion engine 10. As explained below, these interference signals allow conclusions as to the positions of the valves and/or of the camshaft angle.

Each cylinder pressure sensor 32 can advantageously be constructed and operate in accordance with all the pressure measurement principles already known from the prior art. Even if the sensor signal P supplied thereby is determined primarily by the pressure prevailing in the relevant cylinder 12, there is an effect on the sensor signal P in practice owing to noise or structure-borne noise, to some extent as a product of pressure measurement, this noise being transmitted to the cylinder pressure sensors.

Fundamentally, such noise is caused by all the mechanical processes in the valve gear, for example. Among the interference signals produced in this way, it is, in turn, those, in particular, which are caused by the conclusion of a valve closing process which dominate. In the illustrative embodiment shown, the landing of the valve disk of the inlet valve 16 on the valve sealing area of the engine block, for example, leads to a corresponding (characteristic) interference signal in the cylinder pressure signal P.

By means of evaluation of the cylinder pressure signal P, it is thus possible to detect very precisely the point in time at which the inlet valve 16 closes.

In principle and as a departure from the illustrative embodiment shown, it is conceivable to use less than one cylinder pressure sensor per cylinder 12 that is present. Since, in particular, each valve of the internal combustion engine 10 is in a different spatial relationship (e.g. distance) with respect to a cylinder pressure sensor, it is possible for a particular interference signal to be assigned to a particular valve by means of predetermined evaluation criteria. It is better and simpler in terms of the effort involved in evaluation if, as in the illustrative embodiment, provision is also made for a respective cylinder pressure sensor 32 to be arranged for each cylinder 12 (on a wall delimiting said cylinder, e.g. in the cylinder head).

It is possible to achieve a simplification in the discrimination of interference signals caused by the various valves of one and the same cylinder 12 by not arranging the relevant cylinder pressure sensor 32 "in the center" between the valves, for example, but at significantly different "acoustic spacings" with respect to the individual valves, for example. In this case, the amplitudes of the interference signals, in particular, will differ, depending on the valves from which the relevant acoustic interfering noise emanated.

As a departure from the illustrative embodiment shown in FIG. 1, the internal combustion engine 10 could also have just one single cylinder 12. Such single-cylinder internal combustion engines are often used on motorcycles, for example. In the case of a single-cylinder internal combustion engine too, it is possible to improve or speed up the determination of the camshaft angle during the starting phase in order, on the basis of the result determined, to define a suitable point in time for the first preliminary fuel injection when starting the engine.

One possibility for implementing the evaluation of the cylinder pressure signal P is explained in greater detail below with reference to FIGS. 2 and 3.

Figure 2:
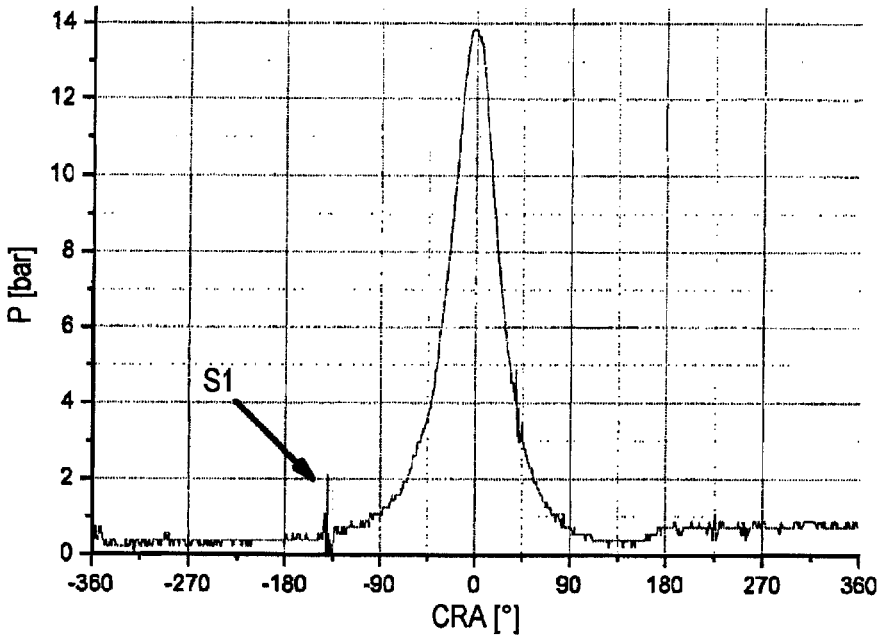
FIG. 2 shows a view of a cylinder pressure signal profile as a function of the crank angle in the engine of FIG. 1.

FIG. 2 shows an illustrative profile of a cylinder pressure signal P, measured on the internal combustion engine 10 by means of the cylinder pressure sensor 16, as a function of the crank(shaft) angle CRA. In this illustration, the value of CRA=0° corresponds to the top dead center position of the piston movement in the cylinder 12. Here, the profile of the signal P is shown for the case of externally driven operation of the internal combustion engine 10. However, a similar signal profile is also obtained in the overrun mode.

Clearly visible in FIG. 2 is an interference signal S1 superimposed on the actual cylinder pressure profile at a crank angle CRA of about −140°, it being possible to assign said signal to the closing of the inlet valve 16 in the example shown.

In one embodiment of the evaluation of the cylinder pressure signal P with regard to such interference components, the cylinder pressure signal P is first of all subjected to high-pass filtering.

Figure 3:
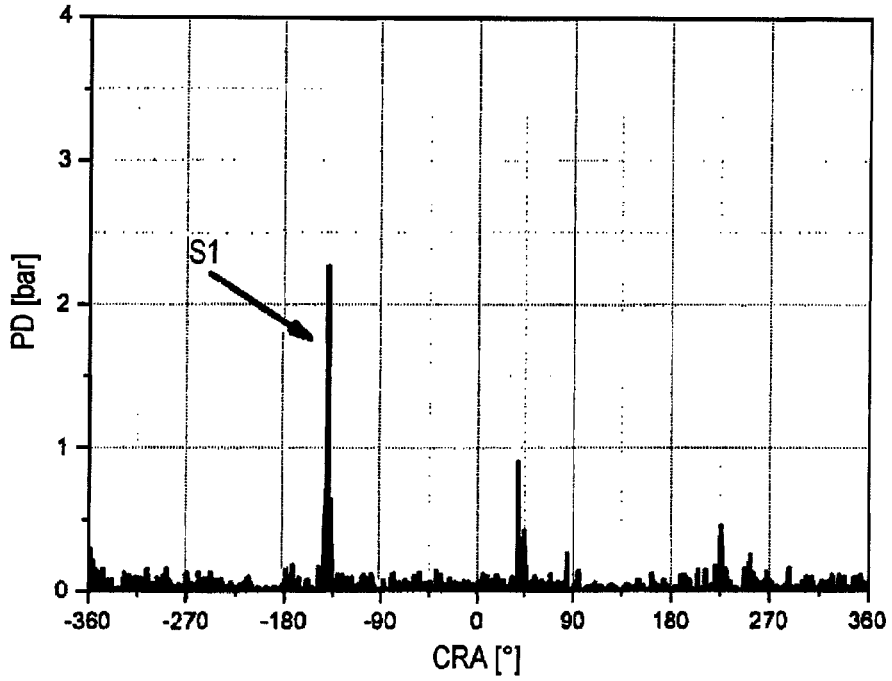
FIG. 3 shows the cylinder pressure signal, after high-pass filtering, plotted against the crank angle.

FIG. 3 shows the result of a high-pass filtering operation on the cylinder pressure signal P of FIG. 2. After high-pass filtering, the signal PD consists almost exclusively of the interference signals, as can be seen from FIG. 3, making it easier to detect the individual interference signals in a subsequent evaluation stage and to assign them to the relevant processes in the valve gear.

After a high-pass filtering operation of this kind, in particular, it is a simple matter to perform evaluation with regard to those interference signals which are caused by the inlet valves and/or outlet valves during the actuation thereof.

As FIG. 3 makes clear, it is in this way possible to determine a "valve closing" signal from the actual cylinder pressure signal P merely by using a simple hi-pass filter and identifying interference pulses (e.g. from the overshooting of a predetermined threshold). As an alternative or in addition to checking the filtered signal for the overshooting of one or more predetermined thresholds, a pattern comparison between the actually detected signal pattern and pre-stored signal patterns assigned to respective valve gear processes could be performed, for example. However, such a pattern comparison may be preferably carried out only for an "interference signal profile" which has already been identified as such beforehand. As already mentioned, the beginning of such an interference signal profile can be identified, for example, by detection of a sudden or abnormal change in the cylinder pressure signal P. The subsequent signal profile obtained can be compared with pre-stored signal patterns for the purpose of identifying the triggering event in order to assign the interference to a particular valve gear process. Such a procedure, in which a pattern comparison is carried out at most for the interference signal itself and not for a more prolonged signal profile, delivers a usable evaluation result particularly quickly.

The rotational position of the camshaft 20 (camshaft angle) in the starting phase of the internal combustion engine 10 is determined fundamentally in a manner known per se, using the crankshaft signal CRK and the camshaft signal CAM. In addition, preferential stoppage angles of the crankshaft 22 can be allowed for, for example, in order thereby to implement a targeted preliminary injection strategy, such as that described in publication DE 100 56 862 C1 already mentioned above. In the internal combustion engine 10 in question, however, the result of the above-explained evaluation of the cylinder pressure signal P (or of the version PD thereof subjected to high-pass filtering) is in all cases allowed for in determining the camshaft angle, at least during the starting phase.

In summary, the susceptibility of the cylinder pressure sensor 32 to interfering noise in the case of the internal combustion engine 10 is exploited in order to derive therefrom information on the position of the engine and thus to allow improved quick starting of the internal combustion engine 10.

With regard to the normal operating phase of the internal combustion engine 10 following an engine starting operation too, the information obtained from the cylinder pressure signal P offers a large number of advantages.

If, for example, the internal combustion engine 10 is fitted with what is known as a variable valve timing system (e.g. "phase converter"), this means that the association between the camshaft angle and valve actuation is no longer clear from or no longer dependent on the state of the adjustment system concerned. Using points in time such as "valve closing" determined from the cylinder pressure signal P, a true physical feedback on the position of the valve is always available to the control unit 24. This information can therefore advantageously be used in the activation of the corresponding adjustment system.

This information can furthermore be used, for example, in order to detect and compensate for faults or deviations in camshaft position sensors (of the variable valve timing system).

It is even possible to operate the engine without a camshaft sensor (by using the result of evaluation of the cylinder pressure signal P instead). Emergency running of the engine in the event of a fault in the crankshaft sensor and/or in the camshaft sensor is furthermore possible, for example.

If the association between the rotational angles of the camshaft 20 and the crankshaft 22 in the basic position is not performed correctly when assembling the engine 10, e.g. when changing a toothed camshaft belt in a motor vehicle workshop, the engine controller 24 has incorrect information on the position of the camshaft 22. Normally, this would make it impossible for the engine control unit 24 to correctly set the parameters for combustion, which can lead to increased emissions, poor engine running and, in extreme cases, even to engine damage. A similar problem arises with deviations due to manufacturing tolerances, aging etc. However, such assembly errors and also any deviations from the desired position or configuration which occur only subsequently during operation can advantageously be detected and allowed for with the aid of evaluation of the cylinder pressure signal P.

In summary, the disclosure relates to the control of a single- or multi-cylinder internal combustion engine (10) having at least one fuel injector (14) per cylinder (12), at least one camshaft (20) for actuating inlet valves (16) and/or outlet valves (18), and a control unit (24), which controls the fuel injectors (14) in such a way that they inject a preliminary fuel injection into each cylinder (12) during a starting phase of the internal combustion engine (10). In order to allow an improved preliminary injection strategy during the starting phase, at least one cylinder pressure signal (P), which is supplied by a cylinder pressure sensor (32) for measuring the pressure in a cylinder (12), is evaluated with regard to interference signals (S1), and the evaluation result is allowed for in a determination of the camshaft angle, at least during the starting phase.

What is claimed is:

1. A method for controlling a single- or multi-cylinder internal combustion engine having at least one fuel injector per cylinder for injecting fuel, at least one camshaft for actuating inlet valves and/or outlet valves, which camshaft rotates at half the speed of a crankshaft, a crankshaft sensor that supplies a crankshaft signal having a synchronization pulse for each crankshaft revolution, said signal representing the crankshaft angle, and a control unit configured to control the fuel injectors during a starting phase and during a normal operating phase, the method comprising:

the control unit receiving at least one cylinder pressure signal from a cylinder pressure sensor for measuring the pressure in an associated cylinder having multiple associated valves, the control unit determining interference signals from the at least one cylinder pressure signal with regard to interference signals, the control unit evaluating the interference signals by:

comparing a particular portion of the interference signals to multiple different pre-stored signal patterns corresponding to the multiple valves or to multiple different valve events, based on the comparison, selecting from the multiple different pre-stored signal patterns a particular pre-stored signal pattern corresponding with the particular portion of the interference signals, determining a particular one of the multiple valves or multiple valve events corresponding to the selected pre-stored signal pattern corresponding with the particular portion of the interference signals, the control unit determining the camshaft angle based at least on an evaluation result of the evaluation, and the control unit controlling the fuel injectors during the starting phase based on the determined camshaft angle.

2. The method of claim 1, wherein the internal combustion engine has a plurality of cylinders, and the cylinder pressure signals of cylinder pressure sensors respectively associated with all the cylinders are evaluated.

3. The method of claim 1, wherein preferential stoppage angles of the crankshaft are also considered in the determination of the camshaft angle during the starting phase.

4. The method of claim 1, wherein the camshaft angle supplied by a camshaft sensor is also considered in the determination of the camshaft angle.

5. The method of claim 4, comprising using the evaluation result during at least one of the starting phase and the normal operating phase to check a plausibility of at least one of the crankshaft signal supplied by the crankshaft sensor and the camshaft signal supplied by the camshaft sensor.

6. The method of claim 1, comprising performing a camshaft angle phase adjustment during the normal operating phase, and controlling the camshaft angle phase adjustment based at least one the evaluation result.

7. A control unit for controlling a single- or multi-cylinder internal combustion engine having at least one fuel injector per cylinder for injecting fuel, at least one camshaft for actuating inlet valves and/or outlet valves, which camshaft rotates at half the speed of a crankshaft, a crankshaft sensor that supplies a crankshaft signal having a synchronization pulse for each crankshaft revolution, said signal representing the crankshaft angle, and a control unit configured to control the fuel injectors during a starting phase and during a normal operating phase, the control unit configured to:

receive at least one cylinder pressure signal from a cylinder pressure sensor for measuring the pressure in an associated cylinder having multiple associated valves, determine interference signals from the at least one cylinder pressure signal with regard to interference signals, evaluate the interference signals by:

comparing a particular portion of the interference signals to multiple different pre-stored signal patterns corresponding to the multiple valves or to multiple different valve events, based on the comparison, selecting from the multiple different pre-stored signal patterns a particular pre-stored signal pattern corresponding with the particular portion of the interference signals, determining a particular one of the multiple valves or multiple valve events corresponding to the selected pre-stored signal pattern corresponding with the particular portion of the interference signals, determine the camshaft angle based at least on an evaluation result of the evaluation, determine the camshaft angle based at least on the identified valve event for the particular identified valve, and control the fuel injectors during the starting phase based on the determined camshaft angle.

8. The control unit of claim 7, wherein the internal combustion engine has a plurality of cylinders, and the cylinder pressure signals of cylinder pressure sensors respectively associated with all the cylinders are evaluated.

9. The control unit of claim 7, wherein preferential stoppage angles of the crankshaft are also considered in the determination of the camshaft angle during the starting phase.

10. The control unit of claim 7, wherein the camshaft angle supplied by a camshaft sensor is also considered in the determination of the camshaft angle.

11. The control unit of claim 10, comprising using the evaluation result during at least one of the starting phase and the normal operating phase to check a plausibility of at least one of the crankshaft signal supplied by the crankshaft sensor and the camshaft signal supplied by the camshaft sensor.

12. The control unit of claim 7, comprising performing a camshaft angle phase adjustment during the normal operating phase, and controlling the camshaft angle phase adjustment based at least one the evaluation result.

13. An internal combustion engine, comprising:

at least one fuel injector per cylinder for injecting fuel, at least one camshaft for actuating at least one inlet valve and/or at least one outlet valve, at least one camshaft for actuating inlet valves and/or outlet valves, which camshaft rotates at half the speed of a crankshaft, a crankshaft sensor that supplies a crankshaft signal having a synchronization pulse for each crankshaft revolution, said signal representing the crankshaft angle, and a control unit configured to control the fuel injectors during a starting phase and during a normal operating phase, wherein the control unit is configured to:

receive at least one cylinder pressure signal from a cylinder pressure sensor for measuring the pressure in an associated cylinder having multiple associated valves, determine interference signals from the at least one cylinder pressure signal with regard to interference signals, evaluate the interference signals by:

comparing a particular portion of the interference signals to multiple different pre-stored signal patterns corresponding to the multiple valves or to multiple different valve events, based on the comparison, selecting from the multiple different pre-stored signal patterns a particular pre-stored signal pattern corresponding with the particular portion of the interference signals, determining a particular one of the multiple valves or multiple valve events corresponding to the selected pre-stored signal pattern corresponding with the particular portion of the interference signals, determine the camshaft angle based at least on an evaluation result of the evaluation, and control the fuel injectors during the starting phase based on the determined camshaft angle.

14. The internal combustion engine of claim 13, wherein the internal combustion engine has a plurality of cylinders, and the cylinder pressure signals of cylinder pressure sensors respectively associated with all the cylinders are evaluated.

15. The internal combustion engine of claim 13, wherein preferential stoppage angles of the crankshaft are also considered in the determination of the camshaft angle during the starting phase.

16. The internal combustion engine of claim 13, wherein the camshaft angle supplied by a camshaft sensor is also considered in the determination of the camshaft angle.

17. The internal combustion engine of claim 16, comprising using the evaluation result during at least one of the starting phase and the normal operating phase to check a plausibility of at least one of the crankshaft signal supplied by the crankshaft sensor and the camshaft signal supplied by the camshaft sensor.

18. The internal combustion engine of claim 13, comprising performing a camshaft angle phase adjustment during the normal operating phase, and controlling the camshaft angle phase adjustment based at least one the evaluation result.

19. The method of claim 1, wherein:

the cylinder pressure sensor for measuring the pressure in each respective cylinder is located with a different acoustic spacing from each of the multiple valves associated with the respective cylinder, such that interference signals from each of the multiple valves have different amplitudes at the cylinder pressure sensor, and distinguishing at least one of (a) a particular one of the multiple valves or (b) a particular one of multiple different valve events that correspond with a particular portion of the interference signals comprises identifying a particular one of the multiple valves that corresponds with the particular portion of the interference signals based on an amplitude of the interference signals.

20. The method of claim 1, wherein distinguishing at least one of (a) a particular one of the multiple valves or (b) a particular one of multiple different valve events that correspond with a particular portion of the interference signals comprises:

comparing the particular portion of the interference signals with one or more stored interference signal profiles; and distinguishing a particular one of multiple different valve events based on the comparison of the particular portion of the interference signals to one or more stored interference signal profiles.

* * * * *